US008919364B1

(12) United States Patent
Russell

(10) Patent No.: US 8,919,364 B1
(45) Date of Patent: Dec. 30, 2014

(54) AUTO-ERECTING TENT

(71) Applicant: Kadestrick D. Russell, Crete, IL (US)

(72) Inventor: Kadestrick D. Russell, Crete, IL (US)

( * ) Notice: Subject to any disclaimer, the term of this patent is extended or adjusted under 35 U.S.C. 154(b) by 0 days.

(21) Appl. No.: 13/926,006

(22) Filed: Jun. 25, 2013

(51) Int. Cl.
*E04H 15/44* (2006.01)
*E04H 15/46* (2006.01)
*E04H 15/48* (2006.01)

(52) U.S. Cl.
CPC ..... *E04H 15/44* (2013.01)
USPC ..... 135/139; 135/141; 135/157

(58) Field of Classification Search
CPC ..... E04H 15/44; E04H 15/46; E04H 15/48
USPC ..... 135/116, 128, 130, 137, 139, 140, 141, 135/142, 148, 153, 157, 88.06; 296/136.12, 296/136.13
See application file for complete search history.

(56) References Cited

U.S. PATENT DOCUMENTS 2,854,015 A * 9/1958 Malte ..... 135/157
3,327,723 A * 6/1967 Burgin ..... 135/147
3,371,671 A * 3/1968 Kirkham ..... 135/139
3,454,021 A * 7/1969 Morris ..... 135/156
4,265,261 A * 5/1981 Barker ..... 135/100
D261,793 S 11/1981 Ferguson
4,366,979 A * 1/1983 Pillot ..... 296/160
4,700,731 A * 10/1987 Smith ..... 135/139
4,934,396 A * 6/1990 Vitta ..... 135/139
4,974,621 A * 12/1990 Lerma ..... 135/139
5,499,646 A 3/1996 Lee
5,806,549 A * 9/1998 Love ..... 135/143
6,581,617 B2 6/2003 Ham et al.
7,341,071 B2 3/2008 Lee
7,509,967 B2 3/2009 Kim
8,453,996 B1 * 6/2013 Papadopoli et al. ..... 256/23
2010/0006131 A1 1/2010 Liu
2012/0085380 A1 * 4/2012 Buckley ..... 135/140

* cited by examiner

*Primary Examiner* — Noah Chandler Hawk

(57) ABSTRACT

The auto-erecting tent is a tent structure in which corners of said tent include automated telescoping members that work simultaneously to extend and retract thereby erecting or lower the tent as needed. Each of the telescoping members includes a motor that drives the telescoping member to extent and retract as needed. The tent is square or rectangular across a floor surface, and telescoping members are located at each corner of the floor surface. Two telescoping members are provided at a first edge, and are connected via a first lateral member whereas the remaining two telescoping members are connected via a second lateral member. A top, telescoping brace attaches to the first lateral member and the second lateral member in order to support a roof surface of the tent.

4 Claims, 4 Drawing Sheets

AUTO-ERECTING TENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of tents and camping equipment, more specifically, a tent that is able to erect itself automatically.

B. Discussion of the Prior Art

As will be discussed immediately below, no prior art discloses a tent in which corners of said tent include automated telescoping members that work simultaneously to extend and retract thereby erecting or lower the tent as needed; wherein each of the telescoping members includes a motor that drives the telescoping member to extent and retract as needed; wherein the tent is square or rectangular across a floor surface; wherein the telescoping members and their respective motors are located at each corner; wherein two telescoping members of a first edge are connected via a first lateral member whereas the remaining two telescoping members are connected via a second lateral member; wherein a top, telescoping brace attaches to the first lateral member and the second lateral member in order to support a roof surface of the tent; wherein the top, telescoping brace is able to disconnect from the first lateral member; wherein the top, telescoping brace is able to retract and fold with respect to the second lateral member and corresponding telescoping members; wherein the tent has side surfaces wherein one of which includes a zipper extending along a height in order to provide ingress into and egress from the tent; wherein the telescoping members connect to the floor surface via a ball swivel so as to lie flat against the floor surface when fully retracted.

The Lee Patents (U.S. Pat. Nos. 7,341,071 and 5,499,646) disclose a tent frame that will automatically collapse and retract with motors located in the top hub and sides. However, the tent frame does not have lateral members and a top, telescoping brace that work to provide the flat roof surface of the tent at bar.

The Ham et al. Patent (U.S. Pat. No. 6,581,617) discloses an automatic self-erecting tent using a spring loaded opening mechanism like that of an umbrella. Again, the tent does not have a flat roof surface supported via a top, telescoping brace that spans across lateral members that are positioned atop of adjacent telescoping members.

The Kim Patent (U.S. Pat. No. 7,509,967) discloses an automatic umbrella style folding tent or shelter apparatus.

The Liu Patent Application Publication (U.S. Pub. No. 2010/0006131) discloses an automatic, motorized folding canopy. However, the canopy does not have a flat roof surface that is parallel with a floor surface, and which is supported via lateral members and a top, telescoping brace.

While the above-described devices fulfill their respective and particular objects and requirements, they do not describe a tent in which corners of said tent include automated telescoping members that work simultaneously to extend and retract thereby erecting or lower the tent as needed; wherein each of the telescoping members includes a motor that drives the telescoping member to extent and retract as needed; wherein the tent is square or rectangular across a floor surface; wherein the telescoping members and their respective motors are located at each corner; wherein two telescoping members of a first edge are connected via a first lateral member whereas the remaining two telescoping members are connected via a second lateral member; wherein a top, telescoping brace attaches to the first lateral member and the second lateral member in order to support a roof surface of the tent; wherein the top, telescoping brace is able to disconnect from the first lateral member; wherein the top, telescoping brace is able to retract and fold with respect to the second lateral member and corresponding telescoping members; wherein the tent has side surfaces wherein one of which includes a zipper extending along a height in order to provide ingress into and egress from the tent; wherein the telescoping members connect to the floor surface via a ball swivel so as to lie flat against the floor surface when fully retracted. In this regard, the auto-erecting tent departs from the conventional concepts and designs of the prior art.

SUMMARY OF THE INVENTION

The auto-erecting tent is a tent structure in which corners of said tent include automated telescoping members that work simultaneously to extend and retract thereby erecting or lower the tent as needed. Each of the telescoping members includes a motor that drives the telescoping member to extent and retract as needed. The tent is square or rectangular across a floor surface, and telescoping members are located at each corner of the floor surface. Two telescoping members are provided at a first edge, and are connected via a first lateral member whereas the remaining two telescoping members are connected via a second lateral member. A top, telescoping brace attaches to the first lateral member and the second lateral member in order to support a roof surface of the tent. The top, telescoping brace is able to disconnect from the first lateral member. The top, telescoping brace is able to retract and fold with respect to the second lateral member and corresponding telescoping members. The tent has side surfaces wherein one of which includes a zipper extending along a height in order to provide ingress into and egress from the tent. The telescoping members connect to the floor surface via a ball swivel so as to lie flat against the floor surface when fully retracted.

It is an object of the invention to provide a tent that is fully automated so as to self-erect and lower as needed.

A further object of the invention is to provide a tent that utilizes telescoping members at each corner of the tent, and which are responsible for simultaneously erecting and lowering the tent.

A further object of the invention is to provide a pivot ball at the base of each telescoping member in order to rotate the telescoping member to a flat position against the floor surface when fully retracted.

Another object of the invention is to provide lateral members on opposing top, sides of the tent, and which connect together via a top, telescoping brace.

Another object of the invention is for the roof surface to be flat and parallel with respect to the floor surface These together with additional objects, features and advantages of the auto-erecting tent will be readily apparent to those of ordinary skill in the art upon reading the following detailed description of presently preferred, but nonetheless illustrative, embodiments of the auto-erecting tent when taken in conjunction with the accompanying drawings.

In this respect, before explaining the current embodiments of the auto-erecting tent in detail, it is to be understood that the auto-erecting tent is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the auto-erecting tent.

It is therefore important that the claims be regarded as including such equivalent construction insofar as they do not depart from the spirit and scope of the auto-erecting tent. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
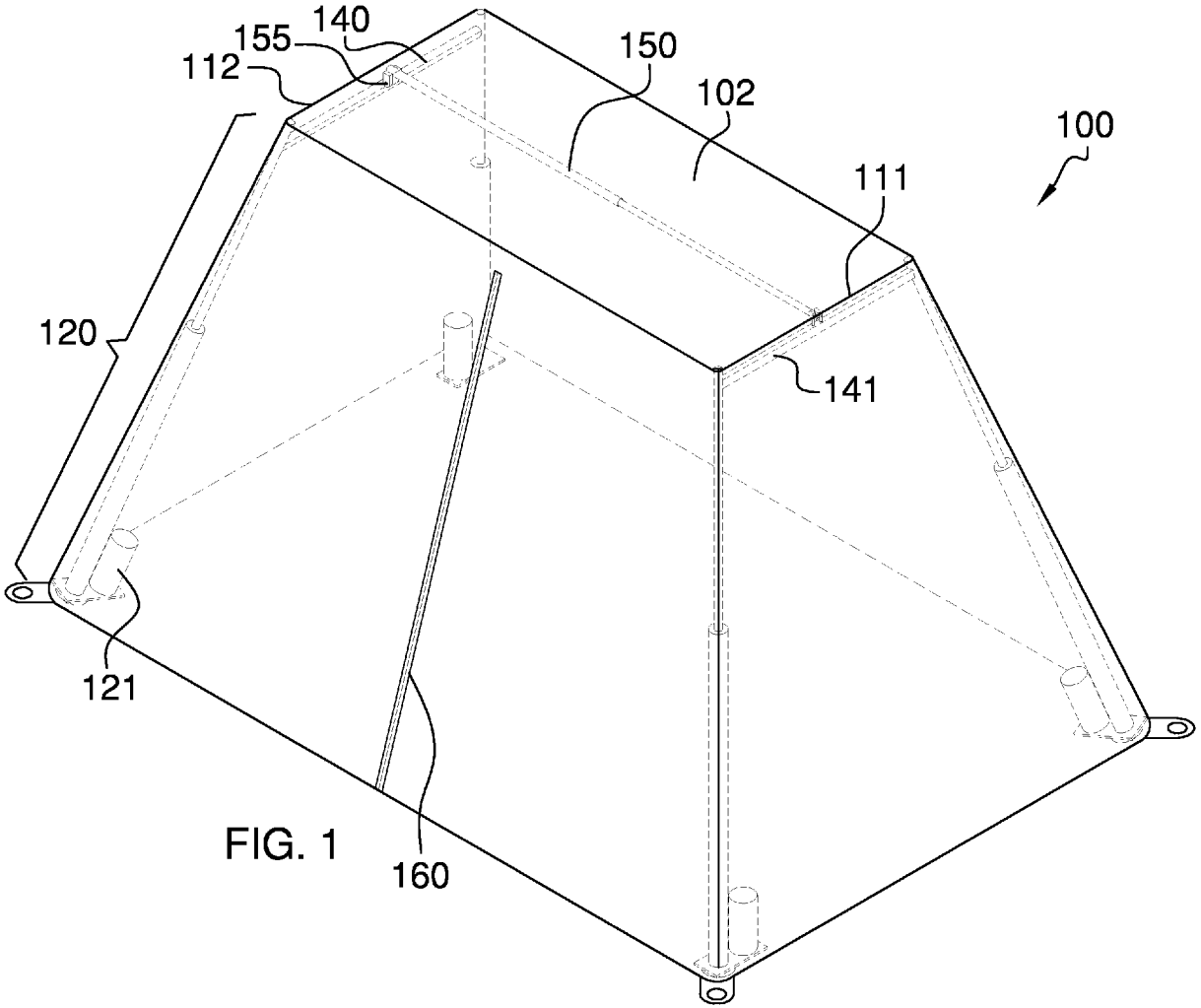
FIG. 1 illustrates a perspective view of the auto-erecting tent.
Figure 2:
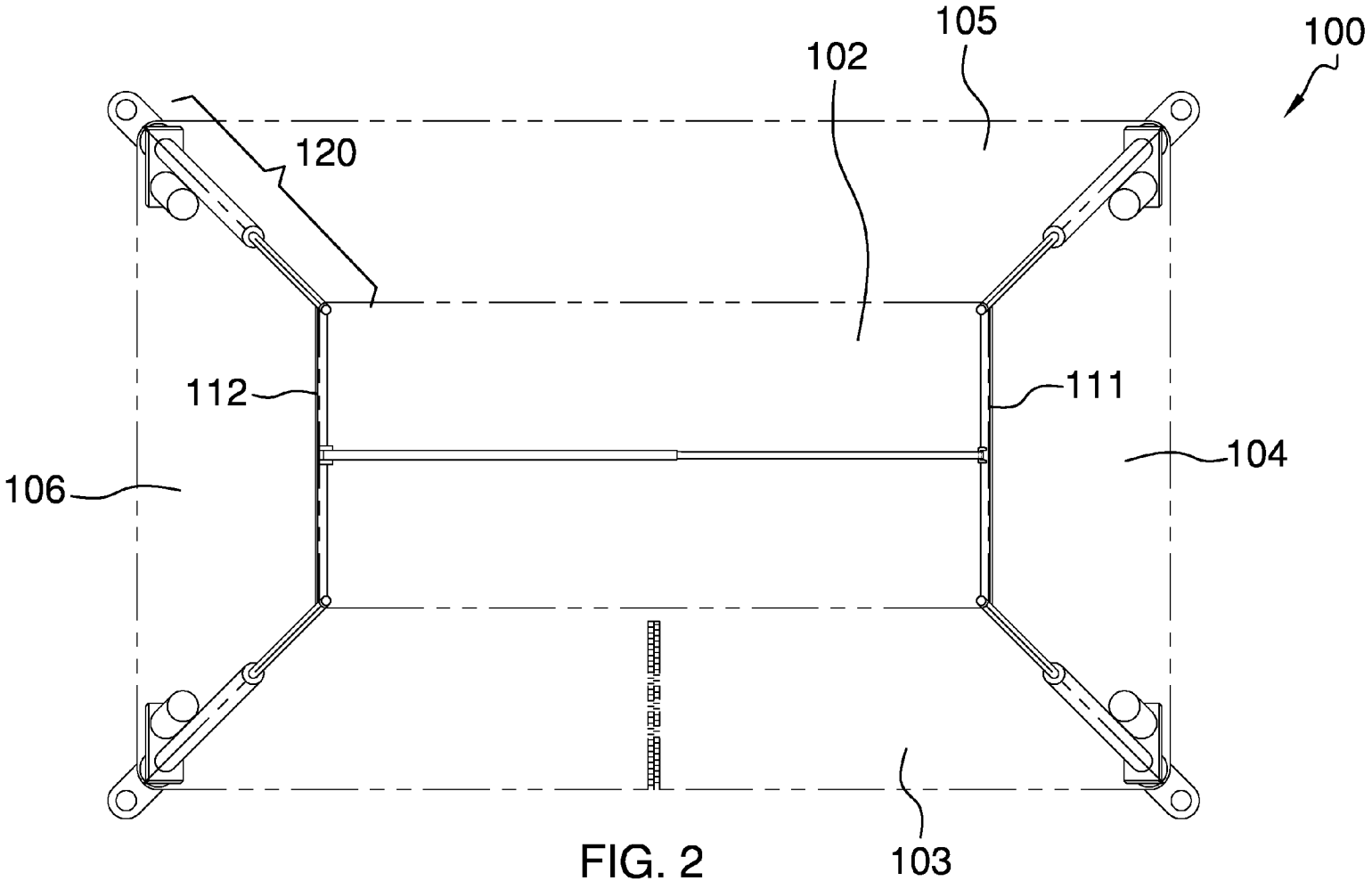
FIG. 2 illustrates a top view of the auto-erecting tent.
Figure 3:
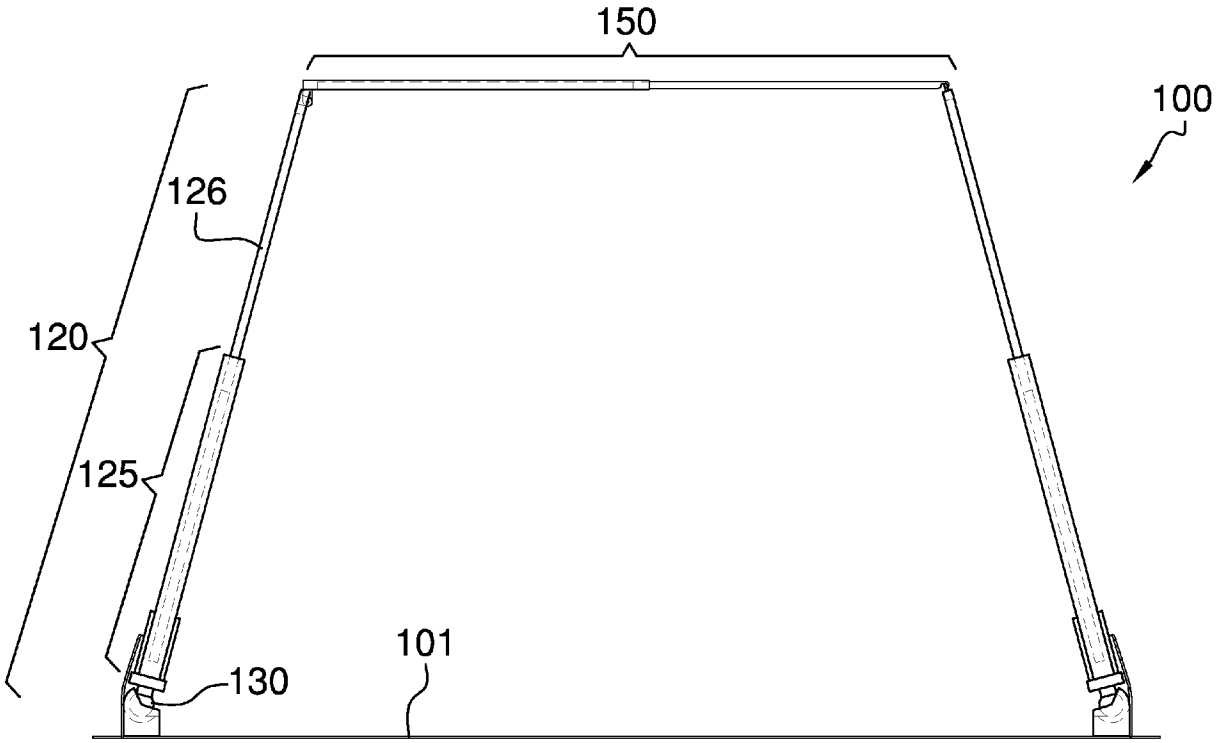
FIG. 3 illustrates a side view of the telescoping members extended and the top, telescoping brace extending in between the lateral members.
Figure 4:
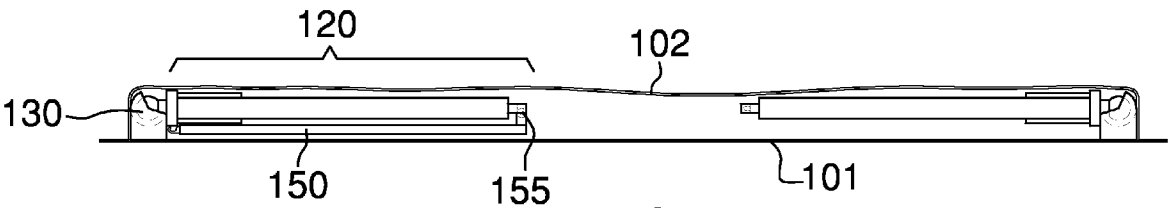
FIG. 4 illustrates a side view of the telescoping members fully retracted and with the top, telescoping brace fully retracted and folded adjacent telescoping members of the second edge.
Figure 5:
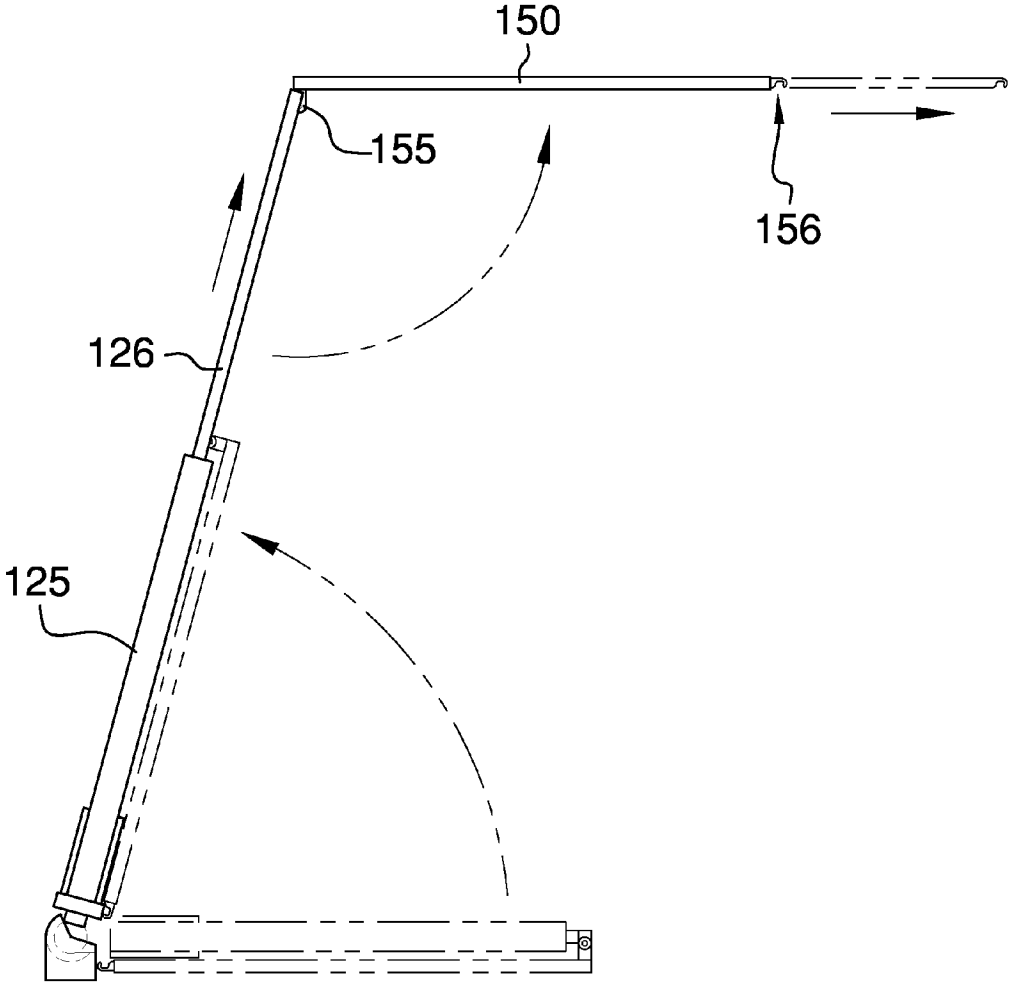
FIG. 5 illustrates another detail showing rotational movement of the top, telescoping brace as well as the telescoping members.

Detailed reference will now be made to the preferred embodiment of the present invention, examples of which are illustrated in FIGS. 1-5. An auto-erecting tent 100 (hereinafter invention) is further defined with a floor surface 101, a roof surface 102, a first side surface 103, a second side surface 104, a third side surface 105, and a fourth side surface 106. The surfaces are made of a flexible fabric that is ideally impermeable or otherwise waterproofed in order to prevent water from entering inside of the invention.

The floor surface 101 is bordered with the first side surface 103, the second side surface 104, the third side surface 105, and the fourth side surface 106. The roof surface 102 is bordered with the first side surface 103, the second side surface 104, the third side surface 105, and the fourth side surface 106. The first side surface 103 is positioned between the fourth side surface 106 and the second side surface 104. The second side surface 104 is positioned between the third side surface 105 and the first side surface 103. The third side surface 105 is positioned between the second side surface 104 and the fourth side surface 106. The fourth side surface 106 is positioned between the third side surface 105 and the first side surface 103.

The floor surface 101 and the roof surface 102 are either square or rectangular. Moreover, the roof surface 102 is a smaller scale of the floor surface 101 in order to form a trapezoidally-shaped object of the invention 100 when fully erected. The invention 100 is further defined with a top, first edge 111 and a top, second edge 112. The top, first edge 111 is on an opposing side of the invention 100 with respect to the top, second edge 112.

The invention 100 includes telescoping members 120 at each corner of the invention 100. The telescoping members 120 are each affixed to the floor surface 101, and extend and retract simultaneously in order to raise and lower the roof surface 102. It shall be noted that the roof surface 102 is raised to form a flat roof surface that is parallel with respect to the floor surface 101.

The telescoping members 120 raise and lower at corners of the invention 100, and which define the places where the various surfaces come together (floor surface 101, first side surface 103, the second side surface 104, the third side surface 105, the fourth side surface 106, and the floor surface 102).

The telescoping members 120 each include a motor 121 that extends and retracts the telescoping member 120. The telescoping member 120 is further defined with a base telescoping member 125 from which a second telescoping member 126 extends from and retracts into. The telescoping members 120 each include a pivot ball 130 that connects to the floor surface 101, and which enables the telescoping member 120 to fold flat when fully retracted.

Two of the telescoping members 120 connect via a first lateral member 140 at the top, first edge 111. The opposing two telescoping members 120 connect via a second lateral member 141 at the top, second edge 112. The lateral members 140 and 141 connect to the respective telescoping members 120 via the respect second telescoping member 126.

A top, telescoping brace 150 attaches in between the first lateral member 140 and the second lateral member 141. Moreover, the top, telescoping brace 150 connects to the second lateral member 141 via a hinge 155. The top, telescoping brace 150 includes a hook member 156 on an opposing end of the top, telescoping brace 150 with respect to the hinge 155. The hook member 156 enables the top, telescoping brace 150 to temporarily connect with the first lateral member 140. Upon disconnection of the hook member 156, the top, telescoping brace 150 is able to retract, and fold via the hinge 155 to a parallel orientation with the two telescoping members 120 of the second edge 111.

The invention 100 includes a zipper 160 on any one of the first side surface 103, the second side surface 104, the third side surface 105, the fourth side surface 106. The zipper 160 being vertically orientated shall enable a means for ingress into and egress out of the invention 100.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An auto-erecting tent:

a floor surface, a roof surface, a first side surface, a second side surface, a third side surface, and a fourth side surface;

wherein a telescoping member is located at each corner of the tent in order to erect and lower the tent as needed;

wherein the floor surface is bordered with the first side surface, the second side surface, the third side surface, and the fourth side surface; wherein the roof surface is bordered with the first side surface, the second side surface, the third side surface, and the fourth side surface;

wherein the first side surface is positioned between the fourth side surface and the second side surface; wherein the second side surface is positioned between the third side surface and the first side surface; wherein the third side surface is positioned between the second side surface and the fourth side surface; wherein the fourth side surface is positioned between the third side surface and the first side surface;

wherein the floor surface and the roof surface are either square or rectangular; wherein the roof surface is a smaller scale of the floor surface such that the tent is a trapezoidally-shaped object when fully erected;

wherein a top, first edge and a top, second edge are opposite one another with respect to the roof surface;

wherein the telescoping members are each affixed to the floor surface, and extend and retract simultaneously in order to raise and lower the roof surface; wherein the roof surface is raised to form a flat roof surface that is parallel with respect to the floor surface;

wherein the telescoping members each include a motor that extends and retracts the telescoping member; wherein the telescoping member is further defined with a base telescoping member from which a second telescoping member extends from and retracts into; wherein the telescoping members each include a pivot ball that connects to the floor surface, and which enables the telescoping member to fold flat when fully retracted.

2. The auto-erecting tent as described in claim 1 wherein two of the telescoping members connect via a first lateral member at the top, first edge; wherein the opposing two telescoping members connect via a second lateral member at the top, second edge; wherein the first later member and the second lateral member are parallel with respect to one another.

3. The auto-erecting tent as described in claim 2 wherein a top, telescoping brace attaches in between the first lateral member and the second lateral member; wherein the top, telescoping brace connects to the second lateral member via a hinge; wherein the top, telescoping brace includes a hook member on an opposing end of the top, telescoping brace with respect to the hinge; wherein the hook member enables the top, telescoping brace to temporarily connect with the first lateral member; where upon disconnection of the hook member, the top, telescoping brace retracts, and fold via the hinge to a parallel orientation with the two telescoping members of the second edge.

4. The auto-erecting tent as described in claim 3 wherein a zipper is included on any one of the first side surface, the second side surface, the third side surface, the fourth side surface; wherein the zipper being vertically orientated enables a means for ingress into and egress out of the tent.

* * * * *